United States Patent [19]

Chattopadhay et al.

[11] 4,154,202

[45] May 15, 1979

[54] FUEL QUANTITY DISTRIBUTOR

[75] Inventors: Asoke Chattopadhay, Neuss-Norf; Günter Kronen, Cologne; Georg Habel, Neuss; Heribert Heisig, Duisburg, all of Fed. Rep. of Germany

[73] Assignee: Pierburg GmbH & Co. KG, Neuss, Fed. Rep. of Germany

[21] Appl. No.: 800,057

[22] Filed: May 24, 1977

[30] Foreign Application Priority Data

Jun. 4, 1976 [DE] Fed. Rep. of Germany ..... 2625128

[51] Int. Cl.[2] ..... F02M 69/00

[52] U.S. Cl. ..... 123/139 AW

[58] Field of Search ..... 123/32 EA, 119 R, 139 AW

[56] References Cited

U.S. PATENT DOCUMENTS

| | | | |
|---|---|---|---|
| Re. 25,842 | 8/1965 | Karpiej | 123/139 AW |
| 3,005,625 | 10/1961 | Holley | 123/139 AW |
| 3,796,199 | 3/1974 | Knapp | 123/32 AE |
| 3,796,200 | 3/1974 | Knapp | 123/119 R |
| 3,919,992 | 10/1975 | Eckert | 123/119 R |
| 3,929,114 | 12/1975 | Chattopadhay et al. | 123/32 AE |
| 3,930,481 | 1/1976 | Eckert | 123/32 AE |
| 3,946,714 | 3/1976 | Eckert et al. | 123/32 AE |
| 3,967,607 | 6/1976 | Eckert | 123/32 AE |
| 3,974,811 | 8/1976 | Stumpp et al. | 123/32 AE |

*Primary Examiner*—Samuel W. Engle
*Assistant Examiner*—S. A. Cangialosi
*Attorney, Agent, or Firm*—Haseltine, Lake & Waters

[57] ABSTRACT

A fuel quantity distributor in which a continuously operating suction pipe injection device is provided with differential pressure valves corresponding to the number of cylinders arranged about the metering unit. The valves maintain the pressure difference of the fuel constant by the metering unit. The valves have, furthermore, a diaphragm which contacts on one side, the delivered fuel. The other side of the diaphragm is exposed to a control pressure. Each of the differential pressure valves is equipped with one of these diaphragms in the form of a metal diaphragm in the plane of the vave seat. A centering ring with a crushing edge for a seal ring, is located in the distributor housing. The metal diaphragm is fixed relative to the valve seat by this centering ring through the use of a cup spring. The diaphragm, moreover, is located in a carrier within the distributor housing. The carrier has a two-part capsule with one half having a diaphragm support ring with inside diameter larger than that of the associated shell of the pressed-on second half of the capsule.

1 Claim, 5 Drawing Figures

FUEL QUANTITY DISTRIBUTOR

BACKGROUND OF THE INVENTION

The present invention relates to a fuel quantity distributor of a continuously operating suction pipe injection device, with differential pressure valves corresponding to the number of cylinders arranged around a metering device. These valves keep the pressure differential of the fuel constant via the metering device; its diaphragm on one side contacts the delivered fuel and on the other side is exposed to a control pressure.

There is already known in the art a device where the diaphragm is a fabric-reinforced plastic element which has needle valves corresponding to the number of cylinders. This diaphragm is mounted between the housing portions of the distributor. It is difficult to uniformly adjust the valves, since the diaphragm has no inherent stability and is stressed by the weight of the needle valves.

From German Pat. No. 18 03 066, there is known the use of an inherently stable metal foil which is located between the housing portions in the plane of the valve seats and forms flat seating valves with them. This device has the disadvantage that the housing portions must be ground for sealing the coarse-surface metal foil and must be made of a deformation-proof material.

Accordingly, it is the object of the present invention to provide a fuel quantity distributor of the above type which combines simple manufacture with accurate operation of the differential pressure valves.

Another object of the present invention is to provide a fuel quantity distributor of the foregoing character which may be readily maintained in service and may be economically fabricated.

A further object of the present invention is to provide a fuel quantity distributor, as described, which has a substantially long operating life.

SUMMARY OF THE INVENTION

The objects of the present invention are achieved by providing that each differential pressure valve has a metal diaphragm in the plane of the valve seat. For sealing purposes, it is advantageous to locate a centering ring with a crushing edge for a sealing ring in the distributor housing. Another embodiment provides that the metal diaphragm be fixed relative to the valve seat by a centering ring via a cup spring. The valve may be designed so that a sphere is rigidly mounted on a spring which is supported on the valve seat.

By locating the diaphragm in a diaphragm carrier and the latter in the distributor housing, it is possible to test the individual differential pressure valves before assembly for their ability to function. In order to install the diaphragm free from stress, the diaphragm carrier is a two-part capsule with one half having a diaphragm support ring. The inside diameter of this support ring is larger than that of the associate shell of the pressed-on second half.

The novel features which are considered as characteristic for the invention are set forth in particular in the appended claims. The invention itself, however, both as to its conconstruction and its method of operation, together with additional objects and advantages thereof, will be best understood from the following description of specific embodiments when read in connection with the accompanying drawings.

DESCRIPTION OF THE PREFERRED EMBODIMENTS

Figure 1:
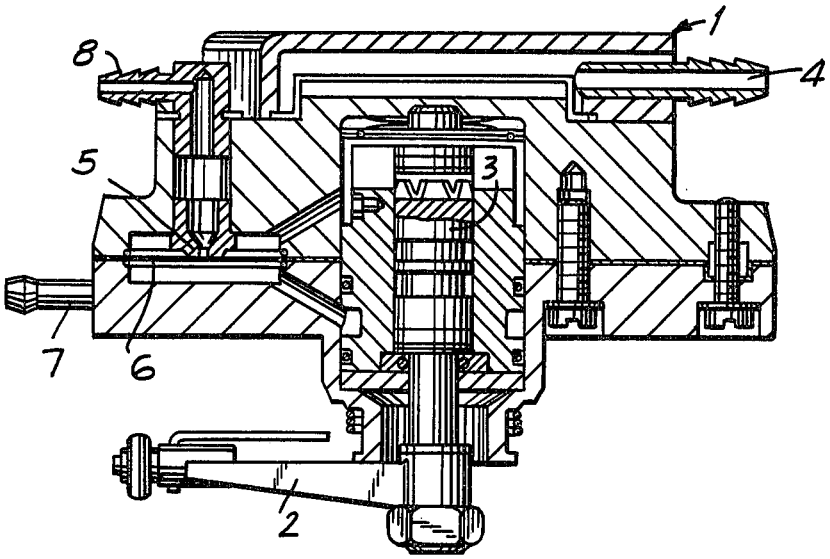
FIG. 1 shows a fuel quantity distributor with a differential pressure valve with individual diaphragm.
Figure 2:
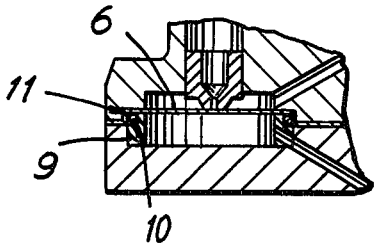
FIG. 2 shows a differential pressure valve with a centering ring.

Referring to the drawings, FIG. 1 shows a fuel quantity distributor 1 of a continuously operating suction pipe injection device. The fuel quantity is distributed by means of a lever 2 through the metering device 3, for example, of a device (not shown) as a function of the air flow. Via a line 4, and control openings of metering device 3, the fuel reaches that side of a metal diaphragm 6 which side acts jointly with the valve seat 5; on the other side, via line 7, there acts a control pressure which can be varied for the running-hot range of the motor, thus leading to a quantity change in the fuel flowing via line 8 to the injection valves (not shown). Each cylinder is assigned a differential pressure valve comprising a valve seat 5 and metal diaphragm 6. The purpose of these valves is to keep the pressure difference constant via metering device 3 for uniform fuel metering. According to FIG. 2, for sealing the valve chambers there is formed by the housing of the fuel quantity distributor 3, from the latter and from each other, a centering ring 9 with a crushing edge 10 for a sealing ring 11.

Figure 3:
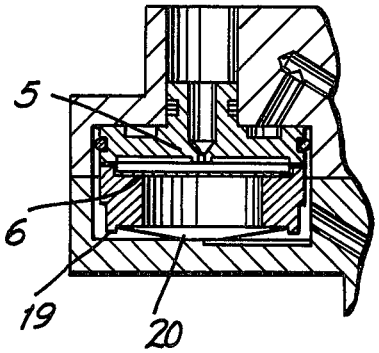
FIG. 3 shows a differential pressure valve with a cup spring.
Figure 4:
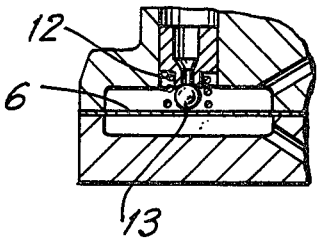
FIG. 4 shows a differential pressure valve with a ball as closure element.
Figure 5:
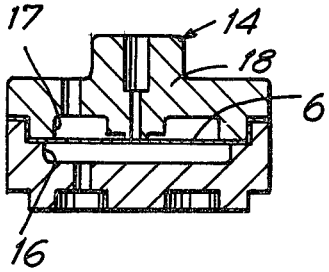
FIG. 5 shows a differential pressure valve as an individual capsule.

According to FIG. 3, the valve is constructed as follows: A centering ring 19 which is located in the housing of the fuel quantity distributor 1 with clearance, is held by a cup spring 20 in a fixed position relative to valve seat 5. This holds the diaphragm 6 free from internal strain and the manufacture of the various rotating parts need not be held to very narrow tolerances. Only the gripping surfaces for the diaphragm must be ground. According to FIG. 4 the valve is arranged so that a sphere 13 rigidly connected to spring 12 is supported via the spring on the valve seat 5. This makes the valve tight (closed) when the sphere 13 contacts the slightly curved back stop of the borehole of the valve seat 5. FIG. 5 shows a diaphragm carrier in the form of a two-part capsule 14; one half 15 of this diaphragm carrier has a diaphragm support ring 16 whose inside diameter is greater than that of the shell 17 of the pressed-on second half 18. As a result, diaphragm 6 has no stresses caused by the assembly installation. The capsule 14 is checked before assembly for functioning ability and inserted by means of seal rings into the housing of the fuel quantity distributor, similar to FIG. 3.

Since the capsules 14 may be manufactured from lathe-turned parts, the machining operations required for installing the differential pressure valves in the distributor housing are not necessary, and the capsules can be inserted into the housing without further operations.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and therefore, such adaptations should and are intended to be comprehended within the meaning and range of equivalence of the following claims.

What is claimed is:

1. A fuel quantity distributor of a continuously operating suction pipe injection device comprising: metering means; a plurality of cylinders arranged about said metering means; differential pressure valves corresponding to the number of said cylinders arranged about said metering means; said valves maintaining the pressure difference of the fuel constant by said metering means; each of said valves having one seperate diaphragm contacting on one side thereof the delivered fuel, the other side of said diaphragm being exposed to a control pressure, each of said valves having a valve seat, said diaphragm comprising a metal diaphragm in the plane of said valve seat, said diaphragm having curvature measurable before assembly for determining whether the curvature exceeds a predetermined amount, curvatures of the diaphragms pointing in the same direction for all valves; a housing; a seal ring; a centering ring with a crushing edge for said seal ring and located in said housing; a cup spring; said metal diaphragm being fixed relative to the valve seat by said centering ring and said cup spring holding said centering ring in a fixed position relative to said valve seat; carrier means for holding said diaphragm in said housing; said carrier means comprising a two-part capsule with one half of said capsule having a diaphragm support ring, said support ring having an inside diameter substantially larger than the diameter of the second half of said capsule, said second half of said capsule comprising a pressed-on shell.

* * * * *